United States Patent [19]

Barinov et al.

[11] Patent Number: 4,736,606

[45] Date of Patent: Apr. 12, 1988

[54] DEVICE FOR MAKING SPRINGS FROM WIRE

[75] Inventors: Alexei P. Barinov; Viktor A. Bazin, both of Barnaul, U.S.S.R.

[73] Assignee: Zavod Transportnogo Machinostroenia Imeni Vladimira Iliicha Lenina, Barnaul, U.S.S.R.

[21] Appl. No.: 85,343

[22] Filed: Aug. 14, 1987

[51] Int. Cl.[4] ..... B21F 3/04

[52] U.S. Cl. ..... 72/144

[58] Field of Search ..... 72/135, 138, 142, 143, 72/144, 371

[56] References Cited

U.S. PATENT DOCUMENTS

| | | | |
|---|---|---|---|
| 379,393 | 3/1888 | Harvey | 72/144 |
| 3,423,980 | 1/1969 | Ludwig et al. | 72/142 |
| 4,084,420 | 4/1978 | Tsutsumino | 72/138 |

FOREIGN PATENT DOCUMENTS

| | | | |
|---|---|---|---|
| 123138 | 3/1959 | U.S.S.R. . | |
| 182099 | 5/1966 | U.S.S.R. | 72/144 |
| 6111707 | 6/1978 | U.S.S.R. | 72/144 |

*Primary Examiner*—E. Michael Combs

*Attorney, Agent, or Firm*—Lilling & Greenspan

[57] ABSTRACT

A device for making springs from wire comprises two driven mandrels located parallel to each other and adapted for winding springs from wire and a carriage feeding wire onto each of these mandrels alternatively while reciprocating along the ways from one extreme position to the other, and backwards.

3 Claims, 3 Drawing Sheets

DEVICE FOR MAKING SPRINGS FROM WIRE

FIELD OF THE INVENTION

The invention relates to plastic metal working, and more particularly it relates to a device for making springs from wire.

The invention can find particular utility in mechanical engineering in making springs with C=I.8 to 3, winding expanders of rectangular piston oil control rings for internal combustion engines, and in making springs with a turn-to-turn pressure, and more specifically, in making Bowden sheathings.

In addition, the device can be adapted for winding spirals from plastic materials and for winding heating element spirals in electrical engineering.

BACKGROUND OF THE INVENTION

There is known a device for making springs from wire, comprising a bed on which a headstock and a tailstock are fixed (SU,A, No. 123138).

The headstock comprises a spindle unit mechanically associated with its rotary primary motion drive, a hollow spindle of which carries a collet mechanically associated with its closing mechanism.

A mandrel serving for spring winding is fitted with its one end into the collet with a nominal clearance equalling two diameters of the wire from which a spring is to be made.

The tailstock comprises a bearing unit, wherein the other end of the mandrel is rigidly secured.

The device also comprises ways arranged along the axis of the spindle, which are in fact grooves provided on the surface of the bed, and a carriage traversable along these ways.

A provision is made for a lead screw, whose one end is associated mechanically with the primary motion drive via the spindle unit and a feed gear-box, while the other end rests upon the bedways. The lead screw serves to facilitate reciprocation of the carriage to the extreme position (spring-winding cycle) and from the extreme position to the initial one (removal of wound springs from the mandrel). there is a nut rigidly secured on the carriage with the lead screw running through its hole.

The device operates as follows.

The mandrel with the pre-wound spring portion is placed in the collet and gripped with the aid of its closing mechanism.

Once the mandrel with the wound spring portion is gripped by the collet, the primary motion drive is cut in to operate the spindle, which imparts rotary motion to the mandrel and the lead screw. While rotating, the lead screw actuates the nut and consequently the carriage, which feeds wire stock onto the mandrel. The rotating mandrel winds wire on itself.

With the carriage in the extreme right-hand position, the spindle comes to a stop, the collet opens, and the wire is no more wound onto the mandrel. At the same time the spindle starts to rotate in the opposite direction and the carriage moves to the extreme left-hand position, the wound spring portion being removed from the mandrel and thrust through the spindle cavity.

With the carriage in the extreme left-hand position, the spindle starts to rotate in the opposite direction, the collet gripping the mandrel with a spring wound on it whereby a new spring portion is wound.

In the known device, the spring-winding cycle alternates with that of removing a wound spring from the mandrel, these two cycles being equal in duration.

Removal of the wound spring portion is an idle run time. Thus the device works almost at 50 percent capacity.

Besides, the screw-nut kinematic pair is worn out severely due to the reciprocating motion of the carriage, whereas the reversible motion greatly affects the primary motion drive, which eventually results in that the kinematic pair and the drive are oftentimes replaced which decreases operating efficiency of the device.

SUMMARY OF THE INVENTION

It is an object of the present invention to provide a device for making springs from wire featuring high operating efficiency.

It is another object of the present invention to provide a device for making springs from wire, wherein there is no idle run of the carriage.

In accordance with the foregoing and other objects, in a device for making springs from wire, comprising a first driven mandrel interposed between a headstock and a tailstock which are fixed in position on a bed, the mandrel serving to wind a first spring on itself from a first wire fed by a carriage transversable along ways arranged parallel to the axis of the mandrel, one end of said mandrel being mechanically associated with its rotary motion drive via a spindle unit provided in the headstock, while the other end is rigidly secured in a bearing unit provided in the tailstock, an improvement resides in the fact that a second driven mandrel is positioned parallel to the first mandrel between the headstock and the tailstock said second mandrel serving for winding a second spring from a second wire which is fed by the carriage positioned on the ways above the bed the ends of said ways being fixed in housings of the headstock and the tailstock, the carriage reciprocating along the ways from the headstock to the tailstock under the action of a force resulting from formation of the last turn of the first spring from the first wire and in the direction from the tailstock to the headstock under the action of a force resulting from formation of the last turn of the second spring from the second wire, the second mandrel being mechanically associated, in the same manner as the first mandrel, with its rotary motion drive via a spindle unit provided in the tailstock and with a bearing unit provided in the headstock.

The provision of the second mandrel for spring winding eliminates idle run. The springs wound onto the mandrels impart reciprocating motion thereto and act as a lead screw.

With the carriage moving to one of the extreme positions, a spring is wound onto one mandrel and at the same time a wound spring is removed form the other mandrel, and with the carriage moving to the other extreme position, a wound spring is removed from one mandrel and at the same time a spring is wound onto the other mandrel.

Thus, operating efficiency of the device greatly increases, namely twofold, due to the elimination of the idle run; besides, the device has no screw-nut kinematic pair subjected to excessive wear. There is no need for reversing the direction of rotation of the primary motion drive, which also contributes to its longer service life.

The advantages mentioned above help reduce the number of overhauls and downtime, thereby also adding to the operating efficiency of the device.

To reduce a unit pressure of a force causing the carriage reciprocation along the ways, it is expedient that the carriage comprise a housing having holes for the ways, and plates fixed on the opposite sides of the housing, each plate having a stepped slot facing its respective side of the housing and adapted to accommodate the mandrel, the width and depth of one step being equal to the outside diameter of the spring wound onto this mandrel, while the width of the other step is equal to the diameter of the mandrel with its depth equalling the sum of the diameter of the mandrel and the diameter of the wire wound onto this mandrel, the housing being provided with an opening for guiding the wire onto the mandrel, which opening faces on the boundary between the slot steps.

It is desirable that the opening for guiding the wire be so arranged that its longitudinal axis makes up an angle with a perpendicular dropped to a longitudinal axis of the stepped slot, said angle being equal to the helix angle of the spring wound onto the respective mandrel.

BRIEF DESCRIPTION OF THE DRAWINGS

In what follows the present invention will now be disclosed in a detailed description of an illustration embodiment thereof with reference to the accompanying drawings, wherein.

DESCRIPTION OF THE PREFERRED EMBODIMENT CONSTRUCTION

Figure 1:
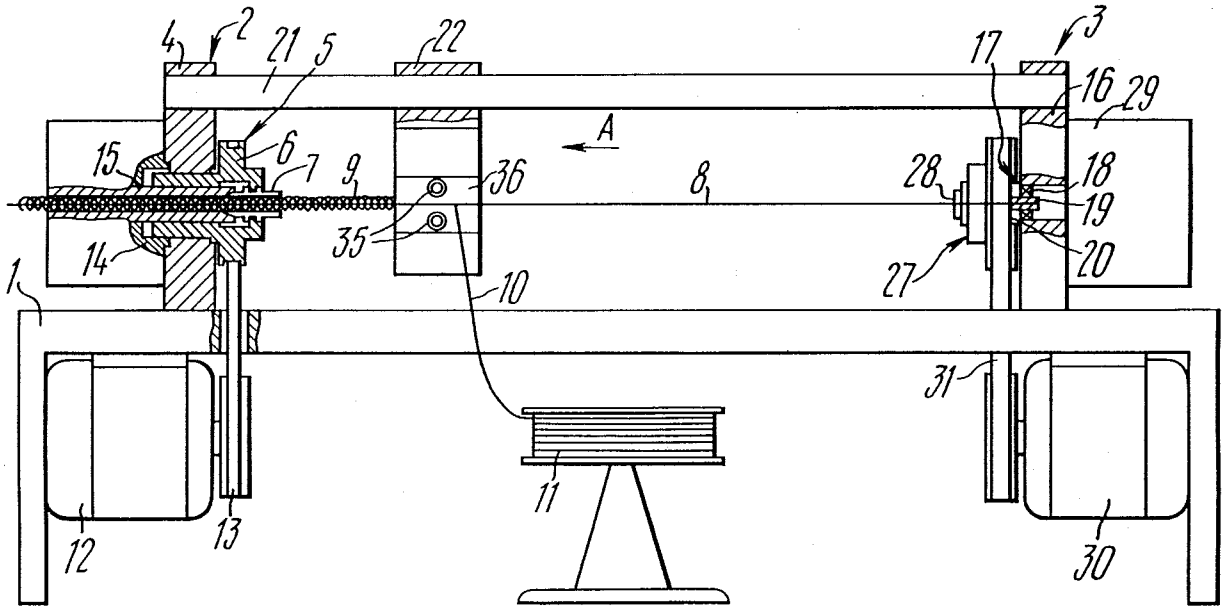
FIG. 1 is a general schematic front view of a device for making springs from wire, according to the invention, with some portions thereof broken away.

The herein-disclosed device for making springs from wire shown in FIG. 1 comprises a bed I with legs carrying a headstock 2 and a tailstock 3.

Provided in a housing 4 of the headstock 2 is a spindle unit 5 having a hollow spindle 6 which is mechanically associated with the rotary/primary motion drive.

The hollow spindle 6 carries a collet 7 mechanically associated with its closing mechanism. A first mandrel 8 serving for winding a first spring 9 using a first wire 10 drawn from a first coil II is fitted with its one end into the collet 7 with a nominal clearance equalling two diameters of the wire 10 from which the spring 9 is to be made.

The rotary/primary motion drive is a motor 12 attached to the bed 1. The drive is mechanically associated with the spindle unit 5 by means of a belt transmission 13 imparting rotary motion from the electric motor 12 to the hollow spindle 6 which imparts rotary motion to the mandrel 8 via the collet 7. The closing mechanism of the collet 7 is a power cylinder 14 provided in the housing 4 of the headstock 2, whose rod 15 is associated with the collet 7.

Provided in a housing 16 of the tailstock 3 is a bearing unit 17, comprising a bearing 18, a sleeve 19 fitted in the bearing 18, and a cap 20. The other end of the mandrel 8 is rigidly secured in the sleeve 19.

Figure 2:
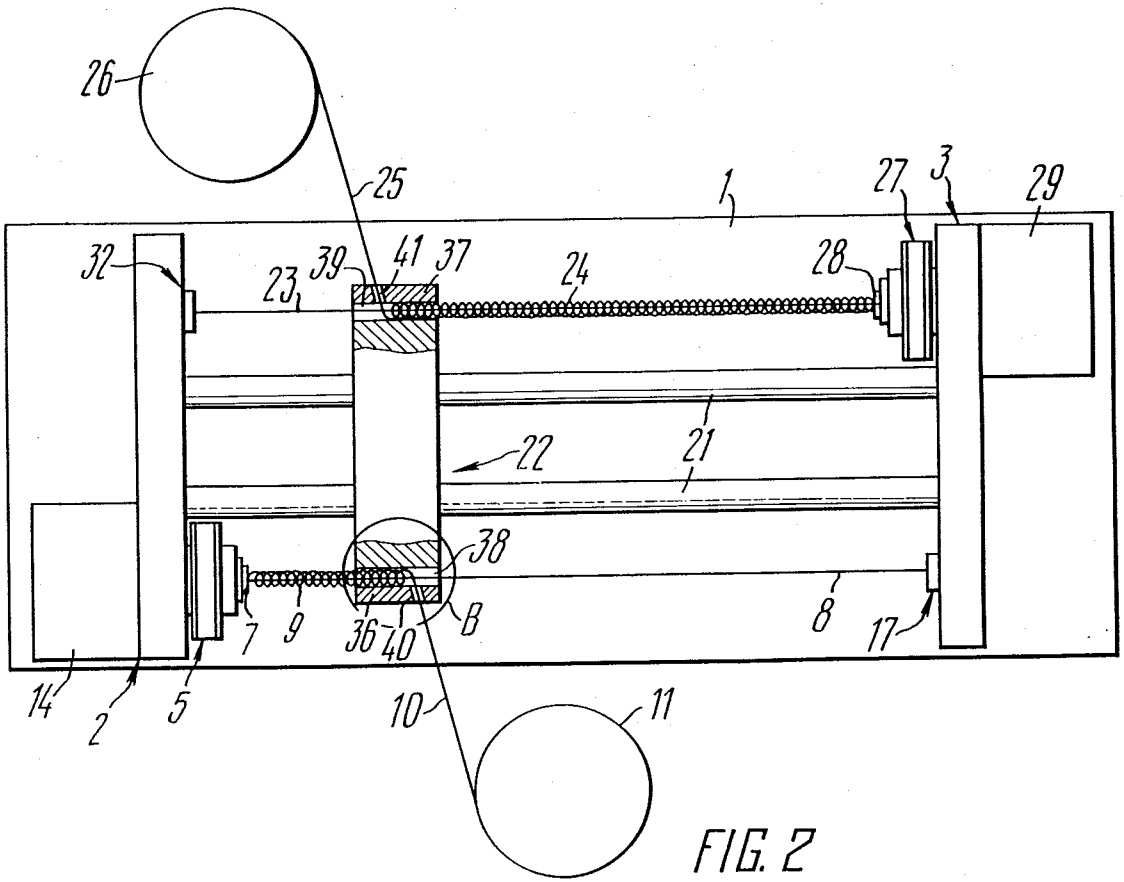
FIG. 2 is a general schematic plan view of the device of FIG. 1 with some portions thereof broken away.

The device for making springs from wire also comprises ways 21 (FIG. 2), arranged along the axis of the hollow spindle 6, and a carriage 22 traversable along the ways 21, which feeds the wire 10 onto the mandrel 8.

In accordance with the invention, the device comprises a second mandrel 23 positioned parallel to the first mandrel 8, which serves for winding a second spring 24 using a second wire 25 drawn from a second coil 26. The mandrel 23 is fixed in the device in the same manner as the mandrel 8. To this end, provision is made for a second spindle unit 27 fitted in the housing 16 of the tailstock 3, whose hollow spindle (purposely omitted in Fig.) carries a collet 28 mechanically associated with its closing mechanism, which is in fact a power cylinder 29, its rotating rod purposely omitted in Fig. being associated with the collet 28. The mandrel 23 is fitted with its one end into the collet 28 with a nominal clearance equalling two diameters of the second wire 25 from which the spring 24 is to be made.

The spindle unit 27 is associated mechanically with its rotary primary motion drive, which is a motor 30 (FIG. 1) mounted on the bed I.

The drive 30 is mechanically associated with the spindle unit 27 by means of a belt transmission 31 imparting rotary motion from the motor 30 to the hollow spindle of the spindle unit 27, which imparts rotary motion via the collet 28 to the mandrel 23.

Provided in the housing 4 of the headstock 2 is a bearing unit 32 (FIG. 2) made in much the same way as the bearing unit 17. The other end of the mandrel 23 is rigidly secured in the bearing unit 32.

The carriage 22 is mounted on the ways 21 above the bed I, whose ends are fitted in the housings 4 and 16 of the headstock 2 and the tailstock 3 respectively. The carriage 22 ensures that the second wire 25 is fed onto the second mandrel 23.

Figure 3:
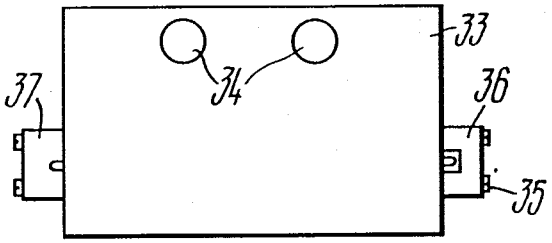
FIG. 3 is a general schematic views of a carriage, according to the invention, facing the arrow A in FIG. 1.
Figure 4:
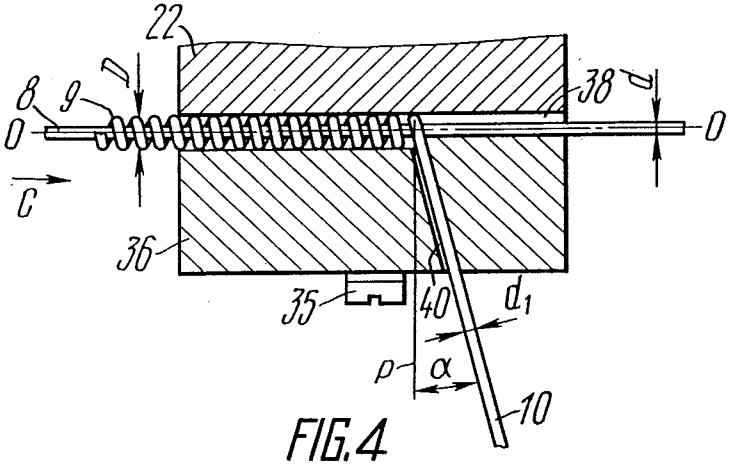
FIG. 4 is a scaled-up representation of unit B in FIG. 2.

The carriage 22 comprises a housing 33 (FIG. 3), which is in fact a plate with holes 34 for the ways 21, and plates 36 and 37 held in position on the opposite sides of the housing with the aid of screws 35. Each plate 36 and 37 has a stepped slot 38 (FIG. 4) and 39 (FIG. 2) respectively facing the respective side of the housing 33 to accommodate the respective mandrel 8 or 23.

Figure 5:
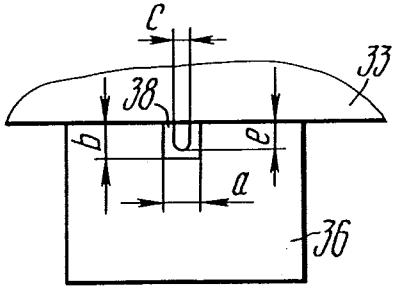
FIG. 5 is a view facing the arrow C in FIG. 4.

Width "a" (FIG. 5) and depth "b" of one step of the slot 38 are equal to the outer diameter D (FIG. 4) of the spring 9 wound onto the mandrel 8 positioned in the slot 38 using the wire 10. Width "c" (FIG. 5) of the other step of the slot 38 is equal to the diameter d (FIG. 4) of the mandrel 8, whereas its depth "e" (FIG. 5) equals the sum of the diameter d of the mandrel 8 and the diameter $d_I$ (FIG. 4) of the wire 10 wound onto this mandrel 8.

The stepped slot 39 is characterized by similar ratios of the width and depth of one step and the width and depth of the other step in compliance with the dimensions of the mandrel 23 and those of the spring 24 wound onto said mandrel using the wire 25. Each plate 36 and 37 has an opening 40 (FIG. 2) and 41 respectively for guiding the respective wire 10 and 25 onto the respective mandrel 8 and 23. The openings 40 and 41 face on the boundary between the slot 38 and 39 steps.

Each opening 40 and 41 for guiding the wire 10 and 25 is so arranged that the longitudinal axis of the opening 40 and 41 makes up an angle $\alpha$ (FIG. 4) with a perpendicular P dropped to a longitudinal axis O—O of the stepped slot 38 and 39, the angle being equal to the helix angle of the spring 9 and 24 wound onto the mandrel 8 and 23.

OPERATION

The device operates as follows. First, preliminary operations are performed: say, the plate 36 is removed from the carriage 22, the wire 10 is drawn from the coil II and passed through the guide opening 40 in the plate 36.

With the end of the wire 10 passing through the guide opening 40, a portion of the spring 9 is wound onto a portion of the wire using the hand-operated contrivance (purposely omitted) with a diameter equal to that of the mandrel 8 and a length ensuring its reliable gripping by the collet 7. The wound portion of the spring 9 is placed in the stepped slot 38 of the plate 36. The plate 36 is mounted on the carriage 22 and secured with the aid of the screws 35.

One end of the mandrel 8 is passed through the wound portion of the spring 9. The carriage 22 is brought to the extreme left-hand position.

With the carriage 22 in the extreme left-hand position, the other end of the mandrel 8 is rigidly secured in the sleeve 19 fitted in the bearing 18 of the bearing unit 17.

Under the operating conditions "adjustment" the spring 9 with the mandrel 8 is gripped by the power cylinder 14 via the rod 15 and the collet 7. A command is delivered from the control panel (not shown in the drawing)for switching on the motors 12 and 30, which impart rotary motion to the spindle units 5 and 27 via the belt transmissions 13 and 31, the spindle 6 starting to transmit torque to the mandrel 8 with the spring 9 wound onto it.

The mandrel 8, while rotating, winds the wire 10 on itself, which passes through the guide opening 40 in the plate 36.

When the last turn of the spring 9 is being formed, a force develops between the step of the stepped slot 38 (FIG. 4) and the wire 10 guided onto the mandrel 8 through the opening 40, said force acting in the direction from the headstock 2 to the tailstock 3. The plate 36 imparts this force to the carriage 22, which starts to move from the headstock 2 to the tailstock 3 until it reaches the extreme right-hand position. When in the extreme right-hand position, the power cylinder 14 moves the rod 15 to the left-hand position, thereby making the collet 7 open, after which the carriage 22 comes to a stop. The wire 10 is no more wound onto the mandrel 8. The motors 12 and 30 are shut down. The spindle units 5 and 27 stop rotating.

The plate 37 is removed from the carriage 22. The wire 25 is drawn from the coil 26 and passed through the guide opening 41 in the plate 37. With the end of the wire 25 passing through the guide opening 41, a portion of the spring 34 is wound onto a portion of the wire using the hand-operated contrivance (purposely omitted) with a diameter equal to that of the mandrel 23 and a length ensuring its reliable gripping by the collet 28.

The wound portion of the spring 24 is placed in the stepped slot 39 of the plate 37. The plate 37 is mounted on the carriage 22 and secured with the aid of the screws 35, the end of the wound portion of the spring 24 being placed in the collet 28.

With the plate 37 mounted on the carriage 22, one end of the mandrel 23 facing the headstock 2 is passed through the spring 24.

The other end of the mandrel 23 is rigidly secured in the bearing unit 32.

The spring 24 with the mandrel 23 is gripped by the power cylinder 29 through the collet 28. A command is delivered from the control panel (not shown in the drawing) for switching on the motors 30 and 12. The spindle 6 and the spindle of the spindle unit 27 start to rotate, the spindle of the spindle unit 27 transmitting torque to the mandrel 23 with the spring 24 wound onto it.

The mandrel 23, while rotating, winds the wire 25 on itself, which passes through the guide opening 41 in the plate 37. When the last turn of the spring 34 is being formed, a force develops between the step of the stepped slot 39 (FIG. 2) and the wire 25 guided onto the mandrel 23 through the opening 41, said force acting in the direction from the tailstock 3 to the headstock 2.

The plate 37 imparts this force to the carriage 22, which starts to move from the tailstock 3 to the headstock 2 until it reaches the extreme left-hand position. At the same time the wound portion of the spring 9 is removed from the mandrel 8 by the carriage 22 with the aid of the plate 27.

The wound portion of the spring 9 passes through the collet 7, the hollow spindle 6, and the rod 15 into a receiving bin (purposely omitted).

The carriage 22 moves to the extreme left-hand position.

With the carriage 22 in the extreme left-hand position, the power cylinder 29 makes the collet 28 open, which ungrips the mandrel 23 and the spring 24. The carriage 22 comes to a stop. The motors 30 and 12 are shut down. Following the adjustment of the device for making springs from wire, it is transferred to automatic operation by means of a respective switch on the control panel (purposely omitted).

When in automatic operation, the device functions as follows.

A start button is depressed on the control panel to switch on the motors 12 and 30, which cause the spindle 6 and the spindle of the spindle unit 27 to rotate. The power cylinder 14 grips the spring 9 with the mandrel 8 through the rod 15 and the collet 7. Once the mandrel 8 with the spring 9 is gripped by the collet 7, the spindle 6 transmits torque to the mandrel 8 with the spring 9 wound onto it.

The mandrel 8, while rotating, winds the wire 10 on itself, which is drawn from the coil II to pass through the guide opening 40 in the plate 36.

When the last turn of the spring 9 is being formed, a force develops between the step of the stepped slot 38 and the wire 10 guided onto the mandrel 8 through the opening 40, said force acting in the direction from the headstock 2 to the tailstock 3.

The plate 36 imparts this force to the carriage 22, which starts to traverse from the headstock 2 to the tailstock 3 until it reaches the extreme right-hand position, the portion of the spring 24 wound under the adjustment operating conditions being removed from the mandrel 24 and passed via the collet 28, the hollow spindle of the spindle unit 27, and the rod of the power cylinder 29 into a receiving bin (purposely omitted).

With the carriage 22 in the extreme right-hand position, the power cylinder 14 makes the collet 7 open. Transmission of the torque from the spindle 6 to the mandrel 8 with the spring 9 wound onto it is discontinued. The carriage 22 comes to a stop.

A command is automatically delivered to the power cylinder 29 for closing the collet 28, which grips the mandrel 23 and the spring 24.

Once the mandrel 23 with the spring 24 is gripped by the collet 28, the spindle of the spindle unit 27 starts to transmit torque to the mandrel 23 with the spring 24 wound onto it via the collet 28. The mandrel 23, while rotating, winds the wire 25 on itself, which is drawn from the coil 26 to pass through the guide opening 41 in the plate 37. When the last turn of the spring 24 is being formed, a force develops between the step of the stepped slot 39 and the wire 25 guided onto the mandrel 23 through the opening 41, said force acting in the direction from the tail stock 3 to the headstock 2.

The plate imparts this force to the carriage 22, which moves from the tailstock 3 to the headstock 2, thereby removing the wound portion of the spring 9 from the mandrel 8 with the aid of the plate 36.

The wound portion of the spring 9 passes through the collet 7, the hollow spindle 6, and the rod 15 into a receiving bin (purposely omitted). The carriage 22 moves to the extreme left-hand position.

With the carriage 22 in the extreme left-hand position, the power cylinder 29 makes the collet 28 open, which ungrips the mandrel 23 and the spring 24. The hollow spindle of the spindle unit 27 stops transmitting torque to the mandrel 23 with the spring 24. The carriage 22 comes to a stop. A command is delivered to the power cylinder 14 for closing the collet 7, which grips the mandrel 8 with the spring 9. The hollow spindle 6 transmits torque to the mandrel 8 with the spring 9. The operating cycle is repeated.

The herein-disclosed device for making springs from wire provides for considerably increasing its operating efficiency as compared with the known device of the same type without detriment to the quality of the wound spring.

In addition, the device has overall dimensions not exceeding those of other known devices of the same type, the specific amount of metal being considerably reduced.

The device is reliable in operation, its primary motion drives featuring much longer service life.

What is claimed is:

1. A device for making springs from wire, comprising:

a bead;

a headstock fixed in position on said bed;

a housing for said headstock;

a tailstock fixed in position on said bed;

a housing for said tailstock;

a first spindle unit provided in said housing of said headstock;

a first bearing unit provided in said housing of said tailstock;

a first mandrel interposed between said housings of said headstock and said tailstock and serving to wind a first spring on itself from a first wire;

a first end of said first mandrel being positioned in said first spindle unit in said headstock housing;

a second end of said first mandrel being positioned in said first bearing unit in said tailstock housing;

said first mandrel having a longitudinal axis;

a rotary motion drive for said first mandrel;

said first end of said first mandrel, being mechanically connected to said rotary motion drive via said first spindle unit, its said second end being rigidly secured in said first bearing unit;

a second spindle unit provided in said housing of said tailstock;

a second bearing unit provided in said housing of said headstock;

a second mandrel arranged parallel to said first mandrel between said housings of said headstock and said tailstock and serving to wind a second spring on itself using a second wire;

a first end of said second mandrel being positioned in said second spindle unit of said tailstock housing;

a second end of said second mandrel being positioned in said second bearing unit of said headstock housing;

said second mandrel having a longitudinal axis;

a rotary motion drive for said second mandrel;

said first end of said second mandrel being mechanically connected to its said rotary motion drive via said second spindle unit provided in said housing of said tailstock and its said second end being rigidly secured in said second bearing unit provided in said housing of said headstock;

two ways arranged parallel to said axes of said mandrels, their opposite ends being fixed in said housings of said headstock and said tailstock; and a carriage positioned on said ways above said bed and adapted for feeding the first wire onto said first mandrel for winding the first spring and feeding the second wire onto said second mandrel for winding the second spring, the carriage reciprocating along said ways from said headstock to said tailstock under the action of a force resulting from formation of the last turn of the first spring from the first wire, and in the direction from said tailstock to said headstock under the action of a force resulting from formation of the last turn of the second spring using the second wire.

2. A device as claimed in claim 1, further comprising:

a housing for said carriage having two opposite sides facing said first mandrel and said second mandrel, respectively;

two holes provided in said housing of said carriage for said ways;

a first plate fixed on said housing on a first side thereof which faces said first mandrel;

a second plate fixed on said housing on a second side thereof which faces said second mandrel;

a first stepped slot adapted to accommodate said first mandrel therein and provided in said first plate, which slot faces the first side of said housing, and has a first step, a second step, and a longitudinal axis;

a second stepped slot adapted to accommodate said second mandrel therein, and provided in said second plate, which slot faces the second side of said housing, and has a first step, a second step, and a longitudinal axis;

the first step of said first stepped slot, whose width and depth are equal to the outside diameter of the first spring wound onto said first mandrel;

the first step of said second stepped slot, whose width and depth are equal to the outside diameter of the second spring wound onto said second mandrel;

the second step of said first stepped slot, whose width is equal to the diameter of said first mandrel, while the step depth equals the sum of the diameter of said first mandrel and the diameter of the first wire wound onto said first mandrel;

the second step of said second stepped slot, whose width is equal to the diameter of said second mandrel, while the step depth equals the sum of the diameter of said second mandrel and the diameter of the second wire wound onto said second mandrel;

an opening for guiding said first wire onto said first mandrel, which is provided in said first plate and faces on a boundary between said steps of said first stepped slot; and an opening for guiding said second wire onto said second mandrel provided in said second plate and facing on a boundary between said steps of said second stepped slot.

3. A device as claimed in claim 2, wherein said opening in said first plate has a longitudinal axis which forms an angle with a perpendicular to a longitudinal axis of said first stepped slot, said angle being equal to the helix angle of said first spring wound onto said first mandrel; and said opening in said second plate has a longitudinal axis which forms an angle with a perpendicular to a longitudinal axis of said second stepped slot, the angle being equal to the helix angle of said second spring wound onto said second mandrel.

* * * * *